US009685123B2

(12) United States Patent
Kim et al.

(10) Patent No.: US 9,685,123 B2
(45) Date of Patent: Jun. 20, 2017

(54) METHOD OF TESTING A DISPLAY APPARATUS AND A DISPLAY APPARATUS TESTED BY THE SAME

(71) Applicant: SAMSUNG DISPLAY CO., LTD., Yongin, Gyeonggi-do (KR)

(72) Inventors: Ho-In Kim, Seoul (KR); Won-Jin Seo, Seoul (KR); Jun-Ho Hwang, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 71 days.

(21) Appl. No.: 14/696,884

(22) Filed: Apr. 27, 2015

(65) Prior Publication Data

US 2016/0078825 A1 Mar. 17, 2016

(30) Foreign Application Priority Data

Sep. 12, 2014 (KR) ..... 10-2014-0120997

(51) Int. Cl.
*G09G 3/36* (2006.01)

(52) U.S. Cl.
CPC ... *G09G 3/3607* (2013.01); *G09G 2320/0233* (2013.01); *G09G 2320/0247* (2013.01); *G09G 2320/0276* (2013.01); *G09G 2320/0673* (2013.01)

(58) Field of Classification Search
CPC ..... G09G 3/3607; G09G 2320/0233; G09G 2320/0247; G09G 2320/0276; G09G 2320/0673
See application file for complete search history.

(56) References Cited

U.S. PATENT DOCUMENTS

2006/0268299 A1* 11/2006 Nose ..... G09G 3/3648 358/1.9
2012/0169780 A1 7/2012 Park et al.
2013/0100173 A1* 4/2013 Chaji ..... G09G 5/10 345/690
2016/0086557 A1* 3/2016 Watanabe ..... G09G 3/3648 345/691

FOREIGN PATENT DOCUMENTS

KR 1020080034573 4/2008
KR 1020080070221 7/2008
KR 1020140060007 5/2014

* cited by examiner

*Primary Examiner* — Nelson Rosario
(74) *Attorney, Agent, or Firm* — F. Chau & Associates, LLC

(57) ABSTRACT

In a method of testing a display apparatus, a plurality of minimum compensation data for a plurality of grayscales, respectively and a plurality of maximum compensation data for the plurality of grayscales, respectively are determined. The display apparatus includes a display panel displaying an image having the plurality of grayscales. A plurality of grayscale compensation data corresponding to the plurality of grayscales, respectively are set based on the plurality of minimum compensation data and the plurality of maximum compensation data. A flicker characteristic with respect to the plurality of grayscales is measured based on the plurality of grayscale compensation data and test images displayed on the display panel. The flicker characteristic is optimized by selectively changing the plurality of grayscale compensation data based on the measured flicker characteristic.

18 Claims, 7 Drawing Sheets

METHOD OF TESTING A DISPLAY APPARATUS AND A DISPLAY APPARATUS TESTED BY THE SAME

CROSS-REFERENCE TO RELATED APPLICATION

This application claims priority under 35 U.S.C. §119 to Korean Patent Application No. 10-2014-0120997, filed on Sep. 12, 2014, in the Korean Intellectual Property Office (KIPO), the disclosure of which is incorporated by reference herein in its entirety.

TECHNICAL FIELD

Exemplary embodiments of the present inventive concept relate to a display apparatus, and more particularly to a method of testing a display apparatus and a display apparatus tested by the method.

DISCUSSION OF THE RELATED ART

A liquid crystal display (LCD) apparatus may include a first substrate including a pixel electrode, a second substrate including a common electrode and a liquid crystal layer disposed between the first and second substrates. An electric field may be generated by voltages applied to the pixel electrode and the common electrode. An intensity of the electric field may be adjusted to control transmittance of light passing through the liquid crystal layer, and thus, a desired image may be displayed.

An LCD may have a noticeable flicker. A flickering screen is not desirable. Accordingly, a manufacture may test its LCDs to minimize flicker.

SUMMARY

According to an exemplary embodiment of the present inventive concept, in a method of testing a display apparatus, a plurality of minimum compensation data for a plurality of grayscales, respectively and a plurality of maximum compensation data for a plurality of grayscales, respectively, are determined. The display apparatus includes a display panel is configured to display an image having the plurality of grayscales. A plurality of grayscale compensation data for the plurality of grayscales, respectively, are set based on the plurality of minimum compensation data and the plurality of maximum compensation data. A flicker characteristic with respect to the plurality of grayscales is measured based on the plurality of grayscale compensation data and test images displayed on the display panel. The flicker characteristic is optimized by selectively changing the plurality of grayscale compensation data based on the measured flicker characteristic.

In determining the plurality of minimum compensation data and the plurality of maximum compensation data, first minimum compensation data and first maximum compensation data for a first grayscale among the plurality of grayscales may be determined. Second minimum compensation data and second maximum compensation data for a second grayscale among the plurality of grayscales may be determined.

In setting the plurality of grayscale compensation data, first data may be set as first grayscale compensation data for the first grayscale. The first data may be equal to or greater than the first minimum compensation data, and equal to or smaller than the first maximum compensation data. Second data may be set as second grayscale compensation data for the second grayscale. The second data may be equal to or greater than the second minimum compensation data, and equal to or smaller than the second maximum compensation data.

In measuring the flicker characteristic, a first flicker value with respect to the first grayscale may be obtained based on the first grayscale compensation data. A second flicker value with respect to the second grayscale may be obtained based on the second grayscale compensation data.

In optimizing the flicker characteristic, the first grayscale compensation data may be selectively changed to minimize the first flicker value. The second grayscale compensation data may be selectively changed to minimize the second flicker value.

In selectively changing the first grayscale compensation data, a plurality of third data may be set as a plurality of third grayscale compensation data for the first grayscale. Each of the plurality of third data may be equal to or greater than the first minimum compensation data and equal to or smaller than the first maximum compensation data. Each of the plurality of third data may be different from the first data. A plurality of third flicker values with respect to the first grayscale may be obtained based on the plurality of third grayscale compensation data. Fourth data may be set as the first grayscale compensation data. The fourth data may be one of the first data. The fourth data may have a smaller flicker value than the first flicker value and the plurality of third flicker values.

In selectively changing the first grayscale compensation data, the first grayscale compensation data may be changed within a range of the first minimum compensation data to the first maximum compensation data. A third flicker value with respect to the first grayscale may be obtained based on the changed first grayscale compensation data. The changed first grayscale compensation data may be maintained when the third flicker value is equal to or smaller than the first flicker value. The first grayscale compensation data may be changed to the first data when the third flicker value is greater than the first flicker value.

The first grayscale compensation data may be different from the second grayscale compensation data.

In the method of testing the display apparatus, the plurality of minimum compensation data and the plurality of maximum compensation data may be stored in a storage unit.

In the method of testing the display apparatus, the plurality of grayscale compensation data may be stored in a storage unit after the plurality of grayscale compensation data are set. The plurality of grayscale compensation data may be updated in the storage unit after the flicker characteristic is optimized.

Each of the plurality of minimum compensation data, the plurality of maximum compensation data and the plurality of grayscale compensation data may be digital data.

According to an exemplary embodiment of the present inventive concept, a display apparatus includes a display panel, a data driver, and a timing controller. The display panel is connected to a plurality of data lines. The display panel displays an image having a plurality of grayscales based on image data. The data driver is configured to generate a plurality of data voltages based on the image data and a plurality of grayscale compensation data for the plurality of grayscales, respectively, and to apply the plurality of data voltages to the plurality of data lines. The timing controller is configured to control the data driver, to determine a plurality of minimum compensation data for the plurality of grayscales, respectively and a plurality of maximum compensation data for the plurality of grayscales, respectively, sets the plurality of grayscale compensation data based on the plurality of minimum compensation data and the plurality of maximum compensation data, and to optimize a flicker characteristic with respect to the plurality of grayscales by selectively changing the plurality of grayscale compensation data based on a measurement of the flicker characteristic. The measurement may be obtained from test images that are displayed on the display panel.

The timing controller may include a grayscale compensation data setting unit and a storage unit. The grayscale compensation data setting unit may be configured to determine the plurality of minimum compensation data and the plurality of maximum compensation data, to set the plurality of grayscale compensation data, and to selectively change the plurality of grayscale compensation data to optimize the flicker characteristic. The storage unit may be configured to store the plurality of minimum compensation data, the plurality of maximum compensation data and the plurality of grayscale compensation data.

The timing controller may further include a data compensation unit and a control signal generation unit. The data compensation unit may be configured to selectively compensate the image data. The control signal generation unit may be configured to generate a first control signal for the data driver based on input control signal.

The timing controller may be configured to determine first minimum compensation data and first maximum compensation data for a first grayscale among the plurality of grayscales, and to determine second minimum compensation data and second maximum compensation data for a second grayscale among the plurality of grayscales.

The timing controller may be configured to set first data as first grayscale compensation data for the first grayscale, and to set second data as second grayscale compensation data for the second grayscale. The first data may be equal to or greater than the first minimum compensation data, and equal to or smaller than the first maximum compensation data. The second data may be equal to or greater than the second minimum compensation data, and equal to or smaller than the second maximum compensation data.

The timing controller may be configured to selectively change the first grayscale compensation data to minimize a first flicker value with respect to the first grayscale obtained based on the first grayscale compensation data, and to selectively change the second grayscale compensation data to minimize a second flicker value with respect to the second grayscale obtained based on the second grayscale compensation data.

The timing controller may be configured to set a plurality of third data as a plurality of third grayscale compensation data for the first grayscale, and to set fourth data as the first grayscale compensation data. Each of the plurality of third data may be equal to or greater than the first minimum compensation data and equal to or smaller than the first maximum compensation data. Each of the plurality of third data may be different from the first data. The fourth data may be one of the first data and the plurality of third data. The fourth data may have a smaller flicker value than the first flicker value and the plurality of third flicker values.

The timing controller may be configured to change the first grayscale compensation data within a range of the first minimum compensation data to the first maximum compensation data, to maintain the changed first grayscale compensation data when a third flicker value is equal to, or smaller than the first flicker value, and to change the first grayscale compensation data to the first data when the third flicker value is greater than the first flicker value. The third flicker value with respect to the first grayscale may be obtained based on the changed first grayscale compensation data.

The first grayscale compensation data may be different from the second grayscale compensation data.

According to an exemplary embodiment of the present inventive concept, a test system for a display apparatus is provided. The test system includes a flicker measurement device and the display apparatus. The flicker measurement device is configured to output a plurality of flicker values corresponding to a plurality of grayscales included in an image, respectively to the display apparatus. The display apparatus includes a display panel and a timing controller. The display panel displays the image. The timing controller is configured to determine a plurality of minimum compensation data corresponding to the plurality of grayscales, respectively and a plurality of maximum compensation data corresponding to the plurality of grayscales, respectively, to set the plurality of grayscale compensation data based on the plurality of minimum compensation data and the plurality of maximum compensation data, and to optimize a flicker characteristic with respect to the plurality of grayscales by selectively changing the plurality of grayscale compensation data based on the plurality of flicker values received from the flicker measurement device.

BRIEF DESCRIPTION OF THE DRAWINGS

Illustrative, non-limiting exemplary embodiments of the present inventive concept will be more clearly understood from the following detailed description taken in conjunction with the accompanying drawings in which.

DETAILED DESCRIPTION OF THE EMBODIMENTS

Figure 1:
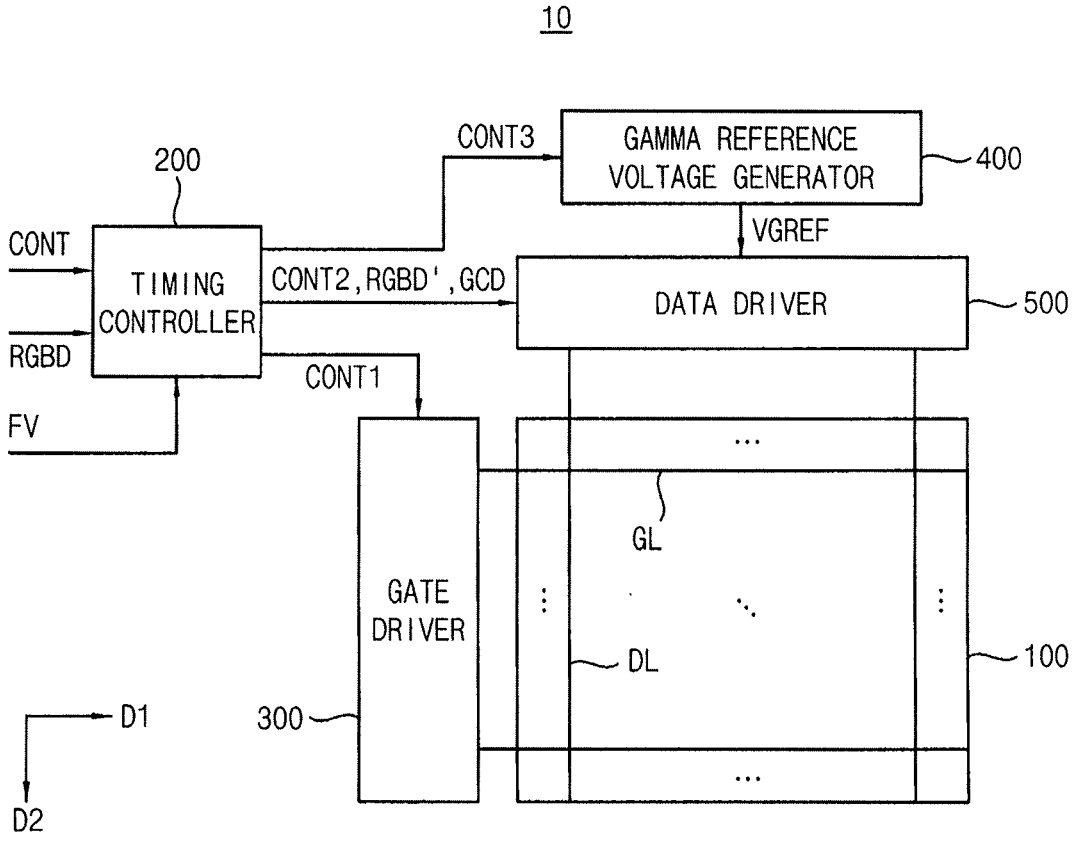
FIG. 1 is a block diagram illustrating a display apparatus according to an exemplary embodiment of the present inventive concept.

Various exemplary embodiments of the present inventive concept will be described more fully with reference to the accompanying drawings. The present inventive concept may, however, be embodied in many different forms and should not be construed as limited to the embodiments set forth herein. Like reference numerals may refer to like elements throughout this application.

It will be understood that when an element is referred to as being "connected" or "coupled" to another element, it can be directly connected or coupled to the other element or intervening elements may be present. As used herein, the singular forms "a," "an" and "the" are intended to include the plural forms as well, unless the context clearly indicates otherwise.

FIG. 1 is a block diagram illustrating a display apparatus according to an exemplary embodiment of the present inventive concept.

Referring to FIG. 1, a display apparatus 10 includes a display panel 100, a timing controller 200, a gate driver 300, a gamma reference voltage generator 400, and a data driver 500.

The display panel 100 is connected to a plurality of gate lines GL and a plurality of data lines DL. The display panel 100 displays an image having a plurality of grayscales based on output image data RGBD'. The gate lines GL may extend in a first direction D1, and the data lines DL may extend in a second direction D2 crossing (e.g., substantially perpendicular to) the first direction D1.

The display panel 100 may include a plurality of pixels that are arranged in a matrix form. Each pixel may be electrically connected to a corresponding one of the gate lines GL and a corresponding one of the data lines DL Each pixel may include a switching element, a liquid crystal capacitor, and a storage capacitor. The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. Each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The timing controller 200 receives input image data RGBD and an input control signal CONT from an external device (e.g., a host). The input image data RGBD may include a plurality of input pixel data for the plurality of pixels, respectively. Each input pixel data may include red grayscale data R, green grayscale data G, and blue grayscale data B for a corresponding one of the plurality of pixels, respectively. The input control signal CONT may include a master clock signal, a data enable signal, a vertical synchronization signal, a horizontal synchronization signal, etc.

The timing controller 200 generates the output image data RGBD', a first control signal CONT1, a second control signal CONT2, and a third control signal CONT3 based on the input image data RGBD and the input control signal CONT. The timing controller 200 controls operations of the display panel 100, the gate driver 300, the gamma reference voltage generator 400, and the data driver 500.

For example, the timing controller 200 may generate the output image data RGBD' based on the input image data RGBD. The output image data RGBD' may be provided to the data driver 500. In an exemplary embodiment of the present inventive concept, the output image data RGBD' may be image data that is substantially the same as the input image data RGBD. In an exemplary embodiment of the present inventive concept, the output image data RGBD' may be compensated image data that is generated by compensating the input image data RGBD. Similarly to the input image data RGBD, the output image data RGBD' may include a plurality of output pixel data for the plurality of pixels, respectively. The timing controller 200 may generate the first control signal CONT1 based on the input control signal CONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 may generate the second control signal CONT2 based on the input control signal CONT. The second control signal CONT2 may be provided to the data driver 500, and a driving timing of the data driver 500 may be controlled based on the second control signal CONT2. The second control signal CONT2 may include a horizontal start signal, a load signal, etc. The timing controller 200 may generate the third control signal CONT3 based on the input control signal CONT. The third control signal CONT3 may be provided to the gamma reference voltage generator 400, and a driving timing of the gamma reference voltage generator 400 may be controlled based on the third control signal CONT3.

In addition, the timing controller 200 generates a plurality of grayscale compensation data GCD for the plurality of grayscales, respectively. The plurality of grayscale compensation data GCD may be used for optimizing a flicker characteristic with respect to the plurality of grayscales. For example, the plurality of grayscale compensation data GCD may be used for asymmetrically compensating a gamma curve (e.g., for performing an asymmetrical gamma tuning). The timing controller 200 determines a plurality of minimum compensation data which correspond to the plurality of grayscales, respectively, and a plurality of maximum compensation data which correspond to the plurality of grayscales, respectively, sets the plurality of grayscale compensation data GCD based on the plurality of minimum compensation data and the plurality of maximum compensation data, and optimizes the flicker characteristic with respect to the plurality of grayscales by selectively changing the plurality of grayscale compensation data GCD based on the flicker characteristic measured from test images that are displayed on the display panel 100. The timing controller 200 may receive a plurality of flicker values FV corresponding to the flicker characteristic from an external flicker measurement device (e.g., an element 30 in FIG. 2).

Detailed configurations and operations of the timing controller 200 will be described with reference to FIGS. 3 through 10.

Figure 2:
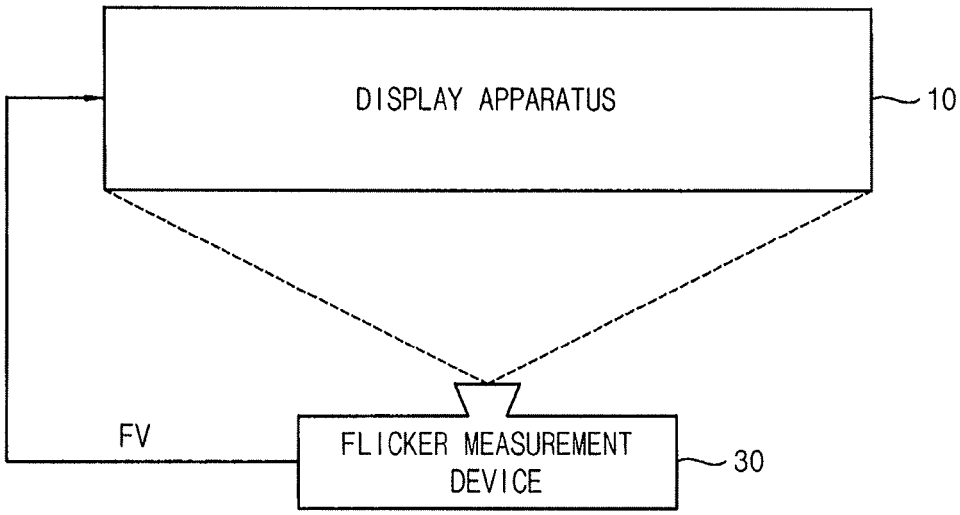
FIG. 2 is a block diagram illustrating a test system for a display apparatus according to an exemplary embodiment of the present inventive concept.

FIG. 2 is a block diagram illustrating a test system for a display apparatus according to an exemplary embodiment of the present inventive concept.

Referring to FIGS. 1 and 2, a test system includes the display apparatus 10 and a flicker measurement device 30.

When the display panel 100 included in the display apparatus 10 displays the test images, the flicker measurement device 30 may measure the flicker characteristic of the display panel 100 to obtain the plurality of flicker values FV. For example, when the display panel 100 displays a first test image among the test images based on a first grayscale among the plurality of grayscales, the flicker measurement device 30 may obtain a first flicker value with respect to the first grayscale. When the display panel 100 displays a second test image among the test images based on a second grayscale among the plurality of grayscales, the flicker measurement device 30 may obtain a second flicker value with respect to the second grayscale. For example, the first test image may be an image for measuring the first flicker value corresponding to the first grayscale, and the second test image may be an image for measuring the second flicker value corresponding to the second grayscale.

The display apparatus 10 may be temporarily connected to the flicker measurement device 30 and may receive the plurality of flicker values FV from the flicker measurement device 30. For example, when the display apparatus 10 is tested while the display apparatus 10 is manufactured, the display apparatus 10 may be temporarily connected to the flicker measurement device 30 and may receive the plurality of flicker values FV obtained by the flicker measurement device 30. For example, the display apparatus 10 may communicate with the flicker measurement device 30 based on an Inter-Integrated Circuit (I2C) interface. When the test for the display apparatus 10 is completed, e.g., when the plurality of grayscale compensation data GCD are completely set, the flicker measurement device 30 may be separated from the display apparatus 10.

Referring back to FIG. 1, the gate driver 300 receives the first control signal CONT1 from the timing controller 200. The gate driver 300 generates gate signals for driving the gate lines GL based on the first control signal CONT1. The gate driver 300 may sequentially output the gate signals to the gate lines GL.

The gamma reference voltage generator 400 receives the third control signal CONT3 from the timing controller 200. The gamma reference voltage generator 400 generates a gamma reference voltage VGREF based on the third control signal CONT3. The gamma reference voltage generator 400 provides the gamma reference voltage VGREF to the data driver 500. The gamma reference voltage VGREF may have values corresponding to grayscales of the plurality of output pixel data included in the output image data RGBD'.

In an exemplary embodiment of the present inventive concept, the gamma reference voltage generator 400 may include a resistor string circuit that has a plurality of resistors connected in series between a power supply voltage and a ground voltage, and the resistor string circuit generates the gamma reference voltage VGREF by dividing the power supply voltage based on the grayscales of the plurality of output pixel data included in the output image data RGBD'. The gamma reference voltage generator 400 may be located inside the data driver 500.

The data driver 500 receives the second control signal CONT2, the output image data RGBD', and the grayscale compensation data GCD from the timing controller 200. The data driver 500 receives the gamma reference voltage VGREF from the gamma reference voltage generator 400. The data driver 500 generates analog data voltages based on the second control signal CONT2, the output image data RGBD', the grayscale compensation data GCD, and the gamma reference voltage VGREF. The data driver 500 may sequentially output the analog data voltages to the data lines DL.

In an exemplary embodiment of the present inventive concept, the data driver 500 may include a shift register, a latch, a signal processor, and a buffer. The shift register may output a latch pulse to the latch. The latch may temporarily store the output image data RGBD', and may output the output image data RGBD' to the signal processor. The signal processor may generate the analog data voltages based on the digital output image data RGBD', the grayscale compensation data GCD, and the gamma reference voltage VGREF, and may output the analog data voltages to the buffer. The buffer may output the analog data voltages to the data lines DL.

In an exemplary embodiment of the present inventive concept, the gate driver 300 and/or the data driver 500 may be disposed, e.g., directly mounted, on the display panel 100. In an exemplary embodiment of the present inventive concept, the gate driver 300 and/or the data driver 500 may be connected to the display panel 100 in a tape carrier package (TCP) type. In an exemplary embodiment of the present inventive concept, the gate driver 300 and/or the data driver 500 may be integrated on the display panel 100.

Figure 3:
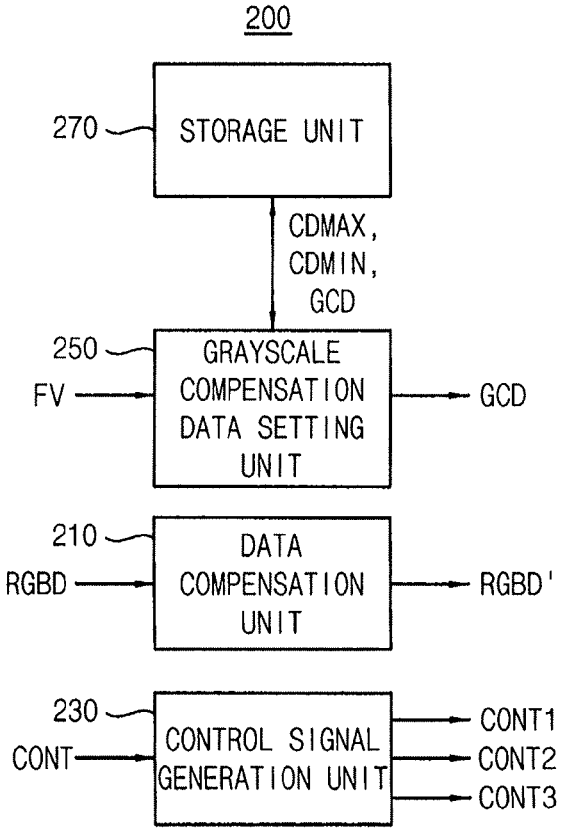
FIG. 3 is a block diagram illustrating a timing controller included in the display apparatus of FIG. 1 according to an exemplary embodiment of the present inventive concept.

FIG. 3 is a block diagram illustrating a timing controller included in the display apparatus of FIG. 1 according to an exemplary embodiment of the present inventive concept.

Referring to FIG. 3, the timing controller 200 may include a data compensation unit 210, a control signal generation unit 230, a grayscale compensation data setting unit 250, and a storage unit 270. The elements (e.g., the data compensation unit 210, the control signal generation unit 230, the grayscale compensation data setting unit 250, and the storage unit 270) of the timing controller 200 may not be physically divided, however, logically divided, as shown in FIG. 3, for convenience of description.

The data compensation unit 210 may receive the input image data RGBD and may generate the output image data RGBD' by selectively compensating the input image data RGBD. For example, the data compensation unit 210 may selectively perform an image quality compensation and/or a spot compensation on the input image data RGBD to generate the output image data RGBD'.

In an exemplary embodiment of the present inventive concept, the data compensation unit 210 may further include an adaptive color correction (ACC) unit and/or a dynamic capacitance compensation (DCC) unit. The ACC unit may receive the input pixel data and may perform an ACC operation on the input pixel data. The ACC unit may compensate grayscales of the input pixel data using a gamma curve. The DCC unit may perform a DCC operation on the input pixel data. The DCC unit may compensate the grayscales of the input pixel data using previous frame image data and present frame image data.

In an exemplary embodiment of the present inventive concept, the data compensation unit 210 may include a single-line memory that stores pixel data corresponding to a single pixel row (e.g., a single horizontal line). In an exemplary embodiment of the present inventive concept, the data compensation unit 210 may include a lookup table for performing compensation.

The control signal generation unit 230 may receive the input control signal CONT and may generate the first control signal CONT1 for the gate driver 300, the second control signal CONT2 for the data driver 500, and the third control signal CONT3 for the gamma reference voltage generator 400 based on the input control signal CONT. The control signal generation unit 230 may output the first control signal CONT1 to the gate driver 300, may output the second control signal CONT2 to the data driver 500, and may output the third control signal CONT3 to the gamma reference voltage generator 400.

The grayscale compensation data setting unit 250 may receive the plurality of flicker values FV and may generate the plurality of grayscale compensation data GCD for the plurality of grayscales, respectively, that are associated with the image displayed on the display panel 100 in FIG. 1. For example, the grayscale compensation data setting unit 250 may determine a plurality of minimum compensation data CDMIN and a plurality of maximum compensation data CDMAX, may set the plurality of grayscale compensation data GCD based on the plurality of minimum compensation data CDMIN and the plurality of maximum compensation data CDMAX, and may selectively change the plurality of grayscale compensation data GCD to optimize the flicker characteristic. The grayscale compensation data setting unit 250 may output the changed plurality of grayscale compensation data GCD to the data driver 500.

The storage unit 270 may store the plurality of minimum compensation data CDMIN, the plurality of maximum compensation data CDMAX, and the plurality of grayscale compensation data GCD. For example, the storage unit 270 may store the plurality of minimum compensation data CDMIN and the plurality of maximum compensation data CDMAX after the grayscale compensation data setting unit 250 determines the plurality of minimum compensation data CDMIN and the plurality of maximum compensation data CDMAX. The storage unit 270 may store the plurality of grayscale compensation data GCD after the grayscale compensation data setting unit 250 sets the plurality of grayscale compensation data GCD. The storage unit 270 may re-store (e.g., update) the plurality of grayscale compensation data GCD after the grayscale compensation data setting unit 250 selectively changes the plurality of grayscale compensation data GCD.

In an exemplary embodiment of the present inventive concept, the storage unit 270 may include at least one nonvolatile memory, such as an erasable programmable read-only memory (EPROM), an electrically erasable programmable read-only memory (EEPROM), a flash memory, a phase change random access memory (PRAM), a resistance random access memory (RRAM), a magnetic random access memory (MRAM), a ferroelectric random access memory (FRAM), a nano floating gate memory (NFGM), a polymer random access memory (PoRAM), etc.

Although FIG. 3 illustrates that the storage unit 270 is included in the timing controller 200, the storage unit 270 may be located outside the timing controller 200 and inside the display apparatus 10, or may be located outside the display apparatus 10 and inside the external device (e.g., the host).

Figure 4:
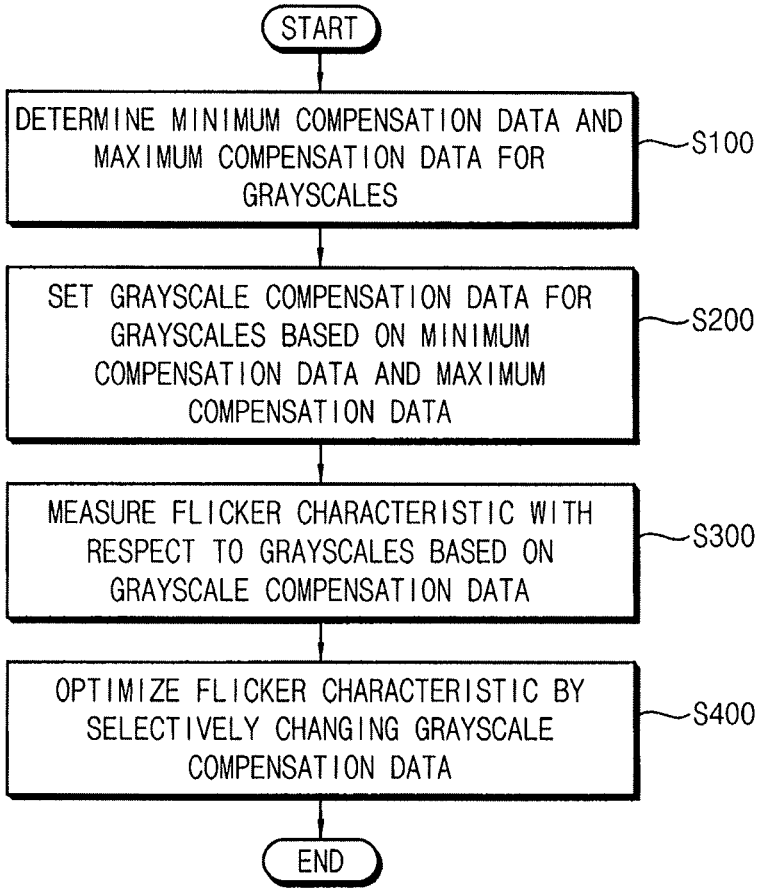
FIG. 4 is a flow chart illustrating a method of testing a display apparatus according to an exemplary embodiment of the present inventive concept.

FIG. 4 is a flow chart illustrating a method of testing a display apparatus according to an exemplary embodiment of the present inventive concept.

Referring to FIGS. 1, 2, 3, and 4, in the method of testing the display apparatus 10 according to an exemplary embodiment of the present inventive concept, a plurality of minimum compensation data CDMIN for a plurality of grayscales, respectively and a plurality of maximum compensation data CDMAX for a plurality of grayscales, respectively are determined (step S100). The display apparatus 10 includes the display panel 100 that displays an image having the plurality of grayscales. A plurality of grayscale compensation data GCD for the plurality of grayscales, respectively are set based on the plurality of minimum compensation data CDMIN and the plurality of maximum compensation data CDMAX (step S200). For example, the timing controller 200 may determine and/or set the minimum compensation data CDMIN, the maximum compensation data CDMAX, and the grayscale compensation data GCD. The minimum compensation data CDMIN, the maximum compensation data CDMAX, and the grayscale compensation data GCD may be determined and/or set while the display apparatus 10 is manufactured (e.g., before the display apparatus 10 is provided to an end user) and/or while compensation for the image is performed.

The display panel 100 may display the image that is represented by the plurality of grayscales. For example, the image may be represented by about 256 grayscales. In other words, the number of the plurality of grayscales may be about 256.

In an exemplary embodiment of the present inventive concept, the timing controller 200 may determine and/or set minimum compensation data, maximum compensation data, and grayscale compensation data for some of the plurality of grayscales, and may obtain minimum compensation data, maximum compensation, data and grayscale compensation data for other grayscales of the plurality of grayscales based on calculations (e.g., interpolations). For example, the timing controller 200 may determine and/or set minimum compensation data, maximum compensation data, and grayscale compensation data for 32nd, 64th, 96th, 128th, 160th, $192^{nd}$, and 224th grayscales among 256 grayscales, and may obtain minimum compensation data, maximum compensation data, and grayscale compensation data for others grayscales among 256 grayscales other than the 32nd, 64th, 96th, 128th, 160th, $192^{nd}$, and 224th grayscales among the 256 grayscales, based on the interpolations. In an exemplary embodiment of the present inventive concept, the timing controller 200 may determine and/or set minimum compensation data, maximum compensation data, and grayscale compensation data for all of the plurality of grayscales (e.g., 256 grayscales).

Flicker characteristic with respect to the plurality of grayscales is measured based on the plurality of grayscale compensation data GCD and test images that are displayed on the display panel 100 (step S300). For example, the flicker measurement device 30 may measure the flicker characteristic of the display panel 100 to obtain a plurality of flicker values FV and may provide the plurality of flicker values FV to the timing controller 200.

The flicker characteristic is optimized by selectively changing the plurality of grayscale compensation data GCD based on the measured flicker characteristic (step S400). For example, the timing controller 200 may selectively change the plurality of grayscale compensation data GCD to optimize the flicker characteristic.

According to an exemplary embodiment of the present inventive concept, the plurality of minimum compensation data CDMIN and the plurality of maximum compensation data CDMAX may be stored in the storage unit 270 after the step S100 is performed. The plurality of grayscale compensation data GCD may be stored in the storage unit 270 after the step S200 is performed. The plurality of grayscale compensation data GCD may be re-stored (e.g., updated) in the storage unit 270 after the step S400 is performed (e.g. after the flicker characteristic is optimized).

In an exemplary embodiment of the present inventive concept, each of the plurality of minimum compensation data CDMIN, the plurality of maximum compensation data CDMAX, and the plurality of grayscale compensation data GCD may be digital data. The plurality of minimum compensation data CDMIN, the plurality of maximum compensation data CDMAX, and the plurality of grayscale compensation data GCD may be different from each other for every grayscale.

In the method of testing the display apparatus 10 according to an exemplary embodiment of the present inventive concept, the grayscale compensation data GCD may be adaptively set and changed in real time to comply with a characteristic and/or a performance of the display panel 100 included in the display apparatus 10. Accordingly, optimized grayscale compensation data GCD may be determined and/or set for each display apparatus, and thus, display apparatuses tested by the method may have the substantially same flicker characteristic as each other regardless of their manufacturing processes.

Hereinafter, an exemplary embodiment of the present inventive concept will be described based on an example where two grayscale compensation data for two grayscales are set and changed.

Figure 5:
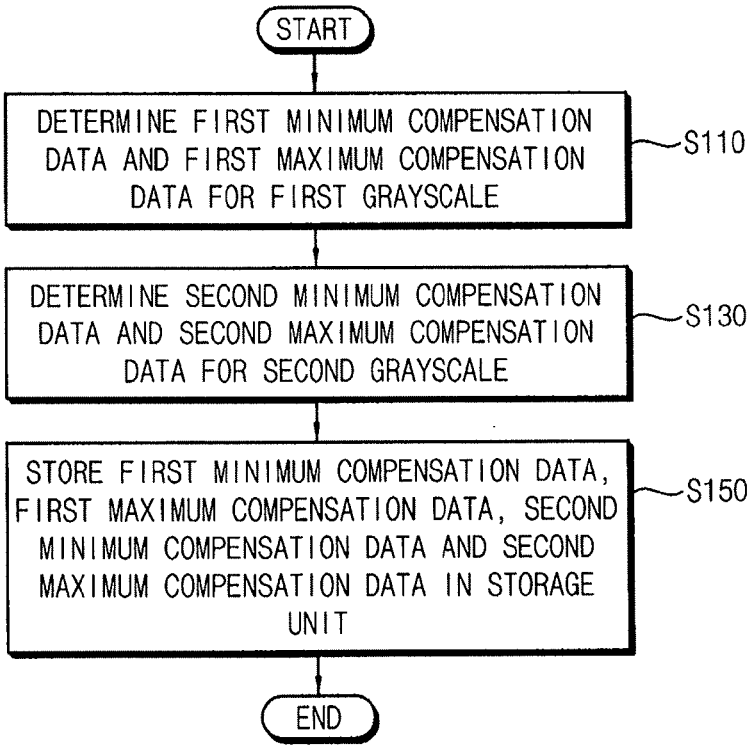
FIG. 5 is a flow chart illustrating step S100 in FIG. 4 according to an exemplary embodiment of the present inventive concept.

FIG. 5 is a flow chart illustrating step S100 in FIG. 4 according to an exemplary embodiment of the present inventive concept.

Referring to FIGS. 1, 4, and 5, in the step S100, first minimum compensation data and first maximum compensation data which correspond to one among the plurality of grayscales may be determined (step S110). For example, the first minimum compensation data (e.g., '0') and the first maximum compensation data (e.g., '19') which correspond to the 32nd grayscale among 256 grayscales may be determined.

Second minimum compensation data and second maximum compensation data which correspond to another one (e.g., a 64th grayscale) among the plurality of grayscales may be determined (step S130). For example, the second minimum compensation data (e.g., '1') and the second maximum compensation data (e.g., '1') which correspond to the 64th grayscale among 256 grayscales may be determined.

As described above, the first minimum compensation data, the first maximum compensation data, the second minimum compensation data, and the second maximum compensation data may be determined while the display apparatus 10 is manufactured and/or while the compensation for the image is performed.

The first minimum compensation data, the first maximum compensation data, the second minimum compensation data, and the second maximum compensation data may be stored in the storage unit 270 (step S150).

The steps S110, S130, and S150 may be performed by the timing controller 200.

Figure 6:
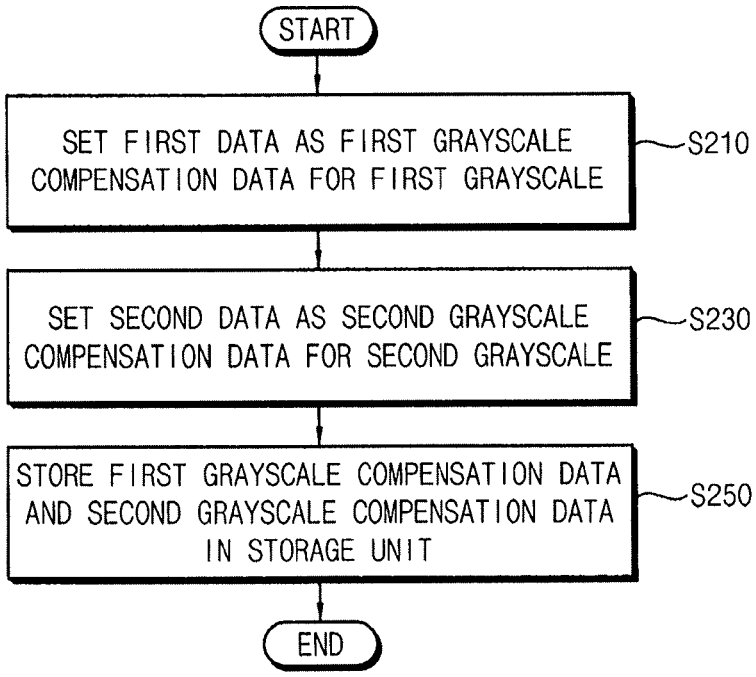
FIG. 6 is a flow chart illustrating step S200 in FIG. 4 according to an exemplary embodiment of the present inventive concept.

FIG. 6 is a flow chart illustrating step S200 in FIG. 4 according to an exemplary embodiment of the present inventive concept.

Referring to FIGS. 1, 4, and 6, in the step S200, first data may be set as first grayscale compensation data corresponding to one (e.g., the 32nd grayscale) of the plurality of grayscales (step S210). The first data may be equal to or greater than the first minimum compensation data, and equal to or smaller than the first maximum compensation data. For example, the first grayscale compensation data for the 32nd grayscale may be set. An initial value of the first grayscale compensation data for the 32nd grayscale may be set to the first data (e.g., '10') that is equal to or greater than the first minimum compensation data (e.g., '0') and equal to or smaller than the first maximum compensation data (e.g., '19').

Second data may be set as second grayscale compensation data corresponding to another one (e.g., 64th grayscale) of the plurality of grayscales (step S230). The second data may be equal to or greater than the second minimum compensation data and equal to or smaller than the second maximum compensation data. For example, the second grayscale compensation data for the 64th grayscale may be set. An initial value of the second grayscale compensation data for the 64th grayscale may be set to the second data (e.g., '9') that is equal to or greater than the second minimum compensation data (e.g., '1') and equal to or smaller than the second maximum compensation data (e.g., '18').

As described above, the initial value of the first grayscale compensation data and the initial value of the second grayscale compensation data may be determined while the display apparatus 10 is manufactured and/or while the compensation for the image is performed.

The first grayscale compensation data and the second grayscale compensation data may be stored in the storage unit 270 (step S250).

The steps S210, S230, and S250 may be performed by the timing controller 200.

Figure 7:
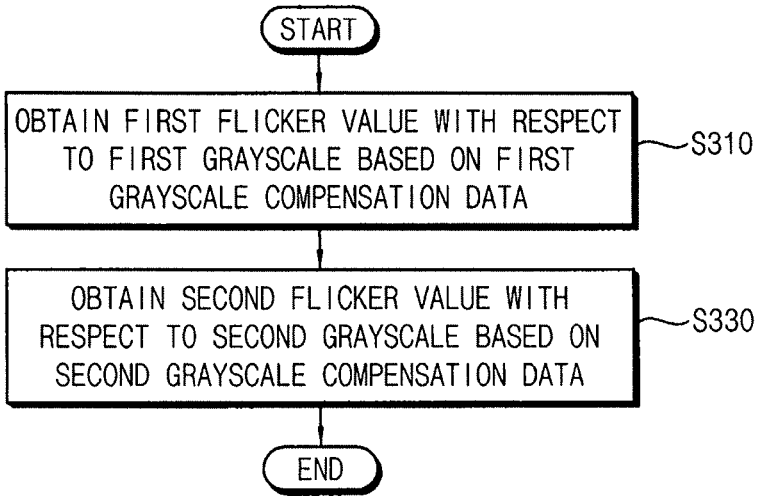
FIG. 7 is a flow chart illustrating step S300 in FIG. 4 according to an exemplary embodiment of the present inventive concept.

FIG. 7 is a flow chart illustrating step S300 in FIG. 4 according to an exemplary embodiment of the present inventive concept.

Referring to FIGS. 1, 2, 4, and 7, in the step S300, a first flicker value corresponding to one (e.g., the 32nd grayscale) of the plurality of grayscales may be obtained based on the first grayscale compensation data (step S310). For example, a first test image that is associated with the 32nd grayscale may be displayed on the display panel 100 based on the first grayscale compensation data. The first flicker value may be obtained from the flicker measurement device 30 and the first test image.

A second flicker value corresponding to another one (e.g., the 64th grayscale) of the plurality of grayscales may be obtained based on the second grayscale compensation data (step S330). For example, a second test image that is associated with the 64th grayscale may be displayed on the display panel 100 based on the second grayscale compensation data. The second flicker value may be obtained from the flicker measurement device 30 and the second test image.

According to an exemplary embodiment of the present inventive concept, the first and second flicker values may be provided from the flicker measurement device 30 to the timing controller 200.

Figure 8:
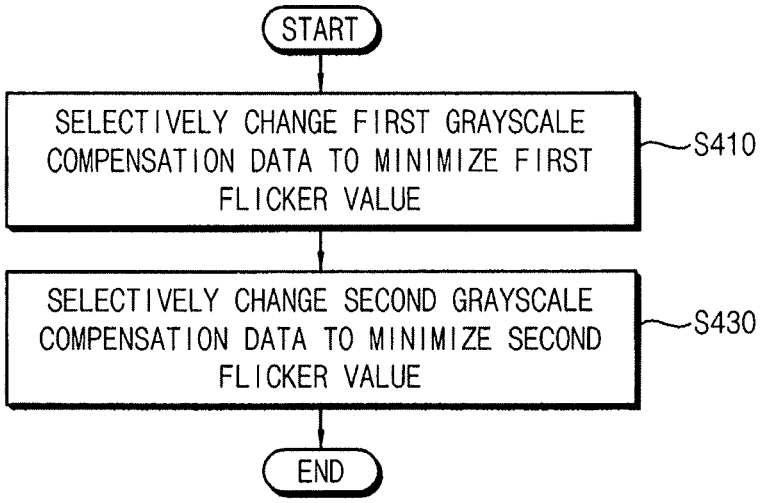
FIG. 8 is a flow chart illustrating step S400 in FIG. 4 according to an exemplary embodiment of the present inventive concept.

FIG. 8 is a flow chart illustrating step S400 in FIG. 4 according to an exemplary embodiment of the present inventive concept.

Referring to FIGS. 1, 4, and 8, in the step S400, the first grayscale compensation data may be selectively changed to minimize the first flicker value (step S410). The second grayscale compensation data may be selectively changed to minimize the second flicker value (step S430). The steps S410 and S430 may be performed by the timing controller 200.

Although FIGS. 4, 7, and 8 illustrates that the steps are performed in an order of S310, S330, S410, and S430, the present inventive concept is not limited thereto. For example, the steps S310 and S410 may be performed and then the steps S330 and S430 may be performed after the steps S310 and S410 are completed.

Figure 9:
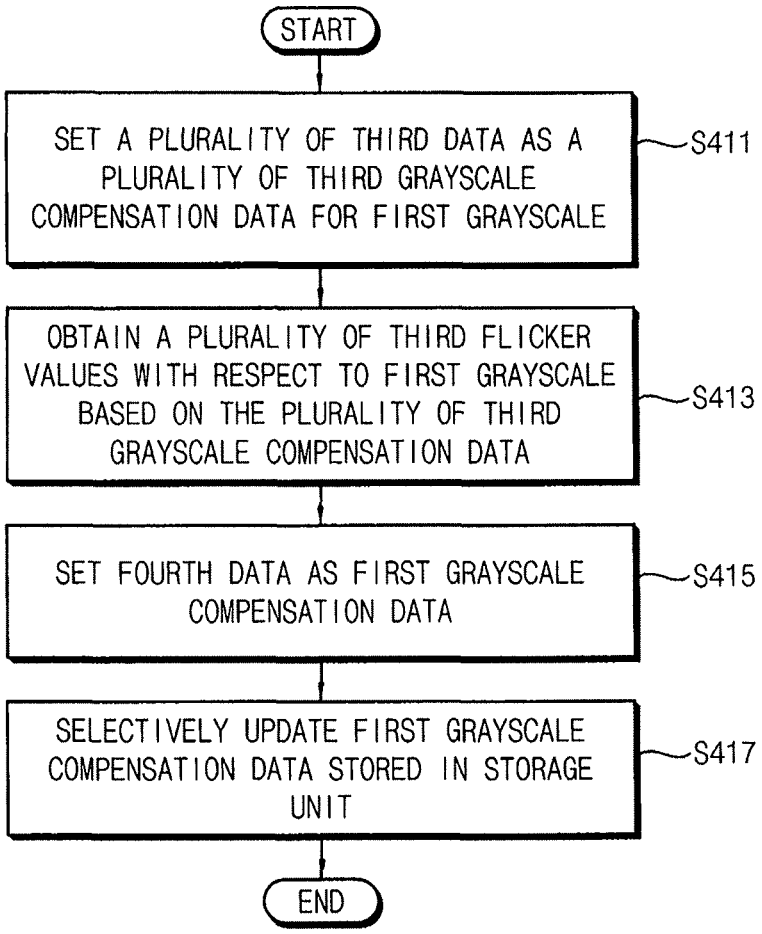
FIG. 9 is a flow chart illustrating step S410 in FIG. 8 according to an exemplary embodiment of the present inventive concept.

FIG. 9 is a flow chart illustrating step S410 in FIG. 8 according to an exemplary embodiment of the present inventive concept.

Referring to FIGS. 1, 2, 8, and 9, in the step S410, a plurality of third data may be set as a plurality of third grayscale compensation data corresponding to one (e.g., the 32nd grayscale) of the plurality of grayscales (step S411). Each of the plurality of third data may be equal to or greater than the first minimum compensation data, may be equal to or smaller than the first maximum compensation data, and may be different from the first data. For example, the plurality of third grayscale compensation data for the 32nd grayscale may be set. The plurality of third grayscale compensation data for the 32nd grayscale may be set to the plurality of third data (e.g., '0' through '9' and '11' through '19'). For example, the plurality of third data are in a range of the first minimum compensation data (e.g., '0') to the first maximum compensation data (e.g., '19'), and each of the plurality of third data is different from the first data (e.g., '10').

A plurality of third flicker values corresponding to one (e.g., 32nd grayscale) of the plurality of grayscales may be obtained based on the plurality of third grayscale compensation data (step S413). For example, the first test image that is associated with the 32nd grayscale may be displayed on the display panel 100 based on one (e.g., '0') of the plurality of third grayscale compensation data. One of the plurality of third flicker values may be obtained from the flicker measurement device 30 and the first test image. In addition, the first test image that is associated with the 32nd grayscale may be displayed on the display panel 100 based on another one (e.g., '1') of the plurality of third grayscale compensation data. Another one of the plurality of third flicker values may be obtained from the flicker measurement device 30 and the first test image. As such, each of the plurality of third flicker values may be obtained based on each of the plurality of third grayscale compensation data. The plurality of third flicker values may be provided from the flicker measurement device 30 to the timing controller 200.

Fourth data may be set as the first grayscale compensation data (step S415). The fourth data may be one of the first data and the plurality of third data. The fourth data may have a smaller flicker value than the first flicker value and the plurality of third flicker values. For example, when the first flicker value is '21,' and one of the plurality of third flicker value is '20,' the fourth data may be one of the plurality of third grayscale compensation data corresponding to the one of the plurality of third flicker value (e.g., '20'), and the fourth data may be set as the first grayscale compensation data. For another example, when the first flicker value is '21,' and all of the plurality of third flicker value are equal to or greater than '21,' the first data (e.g., '10') may be maintained as the first grayscale compensation data.

The first grayscale compensation data stored in the storage unit 270 may be selectively updated (step S417). For example, when one of the plurality of third flicker values is set as the first grayscale compensation data, the first grayscale compensation data stored in the storage unit 270 may be updated to the one of the plurality of third flicker values. For another example, when the first data is set as the first grayscale compensation data, the first grayscale compensation data may not be updated and may be maintained.

The steps S411, S415, and S417 may be performed by the timing controller 200.

Figure 10:
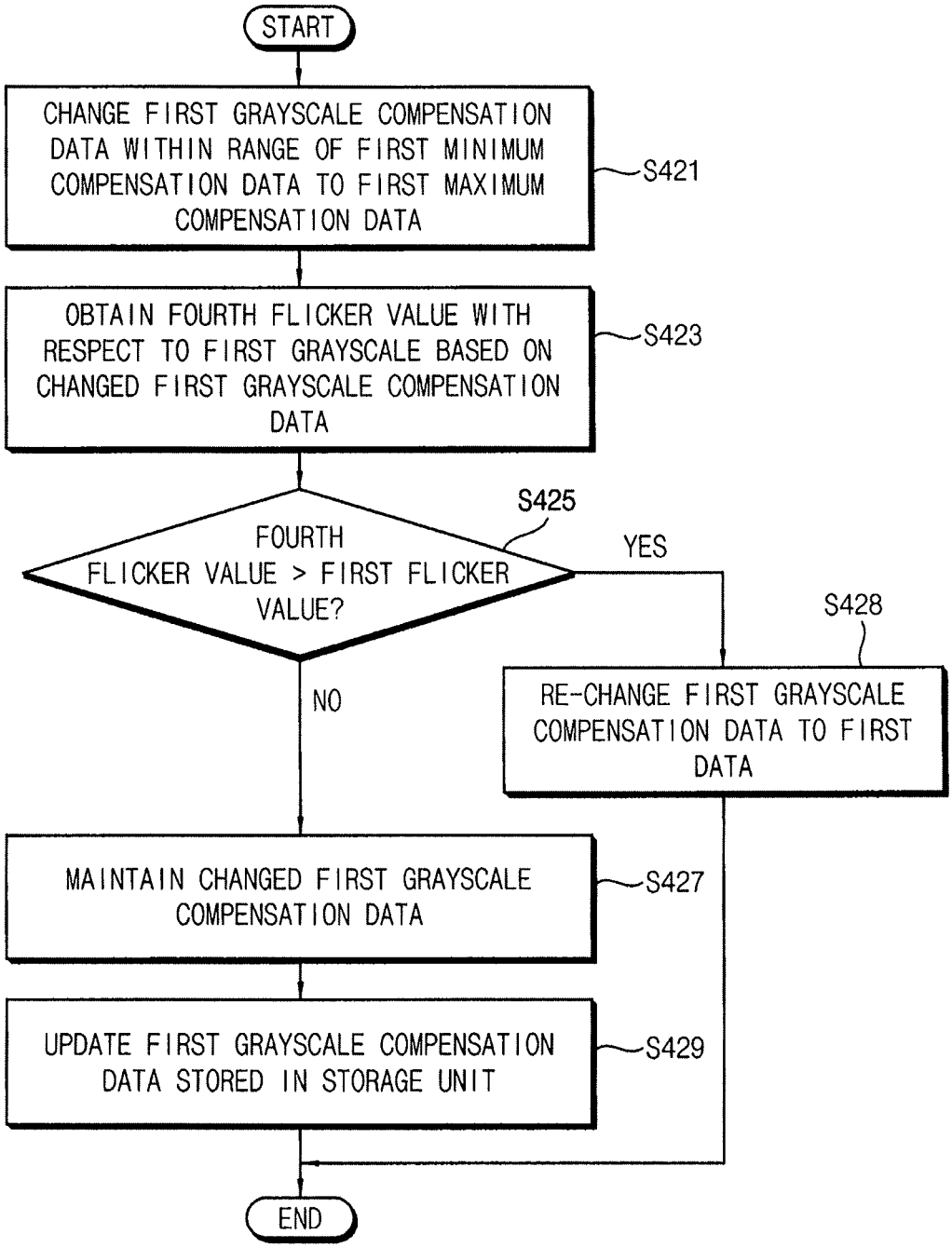
FIG. 10 is a flow chart illustrating step S410 in FIG. 8 according to an exemplary embodiment of the present inventive concept.

FIG. 10 is a flow chart illustrating step S410 in FIG. 8 according to an exemplary embodiment of the present inventive concept.

Referring to FIGS. 1, 2, 8, and 10, in the step S410, the first grayscale compensation data may be changed within a range of the first minimum compensation data to the first maximum compensation data (step S421). For example, the first grayscale compensation data for the 32nd grayscale may be changed from the first data (e.g., '10') to fourth data (e.g., '11') that is equal to or greater than the first minimum compensation data (e.g., '0'), equal to or smaller than the first maximum compensation data (e.g., '19'), and different from the first data (e.g., '10').

A fourth flicker value corresponding to one (e.g., the 32nd grayscale) of the plurality of grayscales may be obtained based on the changed first grayscale compensation data (e.g., the fourth data having data: '11') (step S423). For example, the first test image that is associated with the 32nd grayscale may be displayed on the display panel 100 based on the changed first grayscale compensation data (e.g., '11'). The fourth flicker value may be obtained from the flicker measurement device 30 and the first test image. The fourth flicker value may be provided from the flicker measurement device 30 to the timing controller 200.

The fourth flicker value may be compared with the first flicker value (step S425).

When the fourth flicker value is equal to or smaller than the first flicker value (step S425: NO), the changed first grayscale compensation data may be maintained (step S427), and the first grayscale compensation data stored in the storage unit 270 may be updated (step S429). For example, the first grayscale compensation data stored in the storage unit 270 may be updated to the fourth data (e.g., '11').

When the fourth flicker value is greater than the first flicker value (step S425: YES), the first grayscale compensation data may be changed to the first data (step S428). In this case, since the first data (e.g., '10') is stored as the first grayscale compensation data in the storage unit 270, the first grayscale compensation data stored in the storage unit 270 may not be updated and may be maintained.

The steps S421, S425, S427, S428, and S429 may be performed by the timing controller 200.

The steps S421, S423, S425, S427, S428, and S429 may be repeated for data (e.g., '0' through '9' and '11' through '19') other than the first data (e.g., '10') and between the first minimum compensation data (e.g., '0') and the first maximum compensation data (e.g., '19').

As described above with reference to FIGS. 9 and 10, the first grayscale compensation data for the one of plurality of grayscales (e.g., the 32nd grayscale) may be adaptively set and changed, and thus the flicker corresponding to the first grayscale may be minimized, and the flicker characteristic of the display apparatus 10 may be optimized.

In an exemplary embodiment of the present inventive concept, the step S430 in FIG. 8 may be performed similarly to the step S410 in FIG. 8. For example, the step S430 in FIG. 8 may be performed similarly to the example of FIG. 9 or the example of FIG. 10.

Although the exemplary embodiment of the present inventive concept are described based on the example where two grayscale compensation data for two grayscales, respectively, are set and changed, the present inventive concept is not limited thereto. For example, the exemplary embodiment of the present inventive concept may be employed to an example where at least three grayscale compensation data for at least three grayscales are set and changed. For example, seven grayscale compensation data for seven grayscales (e.g., the 32nd, 64th, 96th, 128th, 160th, 192nd and 224th grayscales among 256 grayscales) may be adaptively set and changed. In this case, seven minimum compensation data and seven maximum compensation data may be determined in the step S100 in FIG. 4, seven initial values of the seven grayscale compensation data for the seven grayscales may be set in the step S200 in FIG. 4, seven flicker values with respect to the seven grayscales may be obtained in the step S300 in FIG. 4, and each of seven grayscale compensation data may be selectively changed to optimize the flicker characteristic in the step S400 in FIG. 4.

The above described embodiments of the present inventive concept may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments of the present inventive concept and the present inventive concept should not to be construed as being limited to the exemplary embodiments disclosed thereof. Although a few exemplary embodiments have been described, it will be understood that many modifications in forms and detail may be possible in the exemplary embodiments without materially departing from the spirit and scope of the present inventive concept, as defined in the appended claims.

What is claimed is:

1. A method of testing a display apparatus, the method comprising:

determining a plurality of minimum compensation data for a plurality of grayscales, respectively, and a plurality of maximum compensation data for the plurality of grayseales, respectively, wherein the display apparatus includes a display panel configured to display an image having the plurality of grayscales;

setting a plurality of grayscale compensation data for the plurality of grayscales, respectively based on the plurality of minimum compensation data and the plurality of maximum compensation data;

measuring a flicker characteristic with respect to the plurality of grayscales based on the plurality of grayscale compensation data and test images displayed on the display panel; and optimizing the flicker characteristic by selectively changing the plurality of grayscale compensation data based on the measured flicker characteristic, wherein determining the plurality of minimum compensation data and the plurality of maxium compensation data includes:

determining first minimum compensation data and first maximum compensation data for a first grayscale among the plurality of grayscales; and determining second minimum compensation data and second maximum compensation data for a second grayscale among the plurality of grayscales.

2. The method of claim 1, wherein setting the plurality of grayscale compensation data includes:

setting first data as first grayscale compensation data for the first grayscale, the first data being equal to or greater than the first minimum compensation data and equal to or smaller than the first maximum compensation data; and setting second data as second grayscale compensation data for the second grayscale, the second data being equal to or greater than the second minimum compensation data and equal to or smaller than the second maximum compensation data.

3. The method of claim 2, wherein measuring the flicker characteristic includes:

obtaining a first flicker value with respect to the first grayscale based on the first grayscale compensation data; and obtaining a second flicker value with respect to the second grayscale based on the second grayscale compensation data.

4. The method of claim 3, wherein optimizing the flicker characteristic includes:

selectively changing the first grayscale compensation data to minimize the first flicker value; and selectively changing the second grayscale compensation data to minimize the second flicker value.

5. The method of claim 4, wherein selectively changing the first grayscale compensation data includes:

setting a plurality of third data as a plurality of third grayscale compensation data for the first grayscale, each of the plurality of third data being equal to or greater than the first minimum compensation data, equal to or smaller than the first maximum compensation data and different from the first data;

obtaining a plurality of third flicker values with respect to the first grayscale based on the plurality of third grayscale compensation data; and setting fourth data as the first grayscale compensation data, the fourth data being one of the first data and the plurality of third data, wherein the fourth data has a smaller flicker value than the first flicker value and the plurality of third flicker values.

6. The method of claim 4, wherein selectively changing the first grayscale compensation data includes:

changing the first grayscale compensation data within a range of the first minimum compensation data to the first maximum compensation data;

obtaining a third flicker value with respect to the first grayscale based on the changed first grayscale compensation data;

maintaining the changed first grayscale compensation data when the third flicker value is equal to or smaller than the first flicker value; and changing the first grayscale compensation data to the first data when the third flicker value is greater than the first flicker value.

7. The method of claim 4, wherein the first grayscale compensation data is different from the second grayscale compensation data.

8. The method of claim 1, further comprising:

storing the plurality of minimum compensation data and the plurality of maximum compensation data in a storage unit.

9. The method of claim 1, further comprising:

storing the plurality of grayscale compensation data in a storage unit after the plurality of grayscale compensation data are set; and updating the plurality of grayscale compensation data in the storage unit after the flicker characteristic is optimized.

10. The method of claim 1, wherein each of the plurality of minimum compensation data, the plurality of maximum compensation data and the plurality of grayscale compensation data is digital data.

11. A display apparatus, comprising:

a display panel connected to a plurality of data lines, wherein the display panel is configured to display an image having a plurality of grayscales based on image data;

a data driver configured to generate a plurality of data voltages based on the image data and a plurality of grayscale compensation data for the plurality of grayscales, respectively, and to apply the plurality of data voltages to the plurality of data lines; and a timing controller configured to control the data driver, to determine a plurality of minimum compensation data for the plurality of grayscales, respectively, and a plurality of maximum compensation data for the plurality of grayscales, respectively, to set the plurality of grayscale compensation data based on the plurality of minimum compensation data and the plurality of maximum compensation data with respect to the plurality of grayscales, and to optimize a flicker characteristic by selectively changing the plurality of grayscale compensation data based on a measurement of the flicker characteristic, wherein the measurement is obtained from test images that are displayed on the display panel, wherein the timing controller is configured to determine first minimum compensation data and first maximum compensation data for a first grayscale among the plurality of grayscales, and to determine second minimum compensation data and second maximum compensation data for a second grayscale among the plurality of grayscales.

12. The display apparatus of claim 11, wherein the timing controller includes:

a grayscale compensation data setting unit configured to determine the plurality of minimum compensation data and the plurality of maximum compensation data, to set the plurality of grayscale compensation data and to selectively change the plurality of grayscale compensation data to optimize the flicker characteristic; and a storage unit configured to store the plurality of minimum compensation data, the plurality of maximum compensation data and the plurality of grayscale compensation data.

13. The display apparatus of claim 12, wherein the timing controller further includes:

a data compensation unit configured to selectively compensate the image data; and a control signal generation unit configured to generate a first control signal for the data driver based on input control signal.

14. The display apparatus of claim 11, wherein the timing controller is configured to set first data as first grayscale compensation data for the first grayscale, and to set second data as second grayscale compensation data for the second grayscale, wherein the first data is equal to or greater than the first minimum compensation data, and equal to or smaller than the first maximum compensation data, and wherein the second data is equal to or greater than the second minimum compensation data and equal to or smaller than the second maximum compensation data.

15. The display apparatus of claim 14, wherein the timing controller is configured to selectively change the first grayscale compensation data to minimize a first flicker value with respect to the first grayscale obtained based on the first grayscale compensation data, and to selectively change the second grayscale compensation data to minimize a second flicker value with respect to the second grayscale obtained based on the second grayscale compensation data.

16. The display apparatus of claim 15, wherein the timing controller is configured to set a plurality of third data as a plurality of third grayscale compensation data for the first grayscale, and to set fourth data as the first grayscale compensation data, wherein each of the plurality of third data is equal to or greater than the first minimum compensation data, equal to or smaller than the first maximum compensation data and different from the first data, and wherein the fourth data is one of the first data and the plurality of third data, wherein the fourth data has a smaller flicker value than the first flicker value and the plurality of third flicker values.

17. The display apparatus of claim 15, wherein the timing controller is configured to change the first grayscale compensation data within a range of the first minimum compensation data to the first maximum compensation data, to maintain the changed first grayscale compensation data when a third flicker value with respect to the first grayscale is equal to or smaller than the first flicker value and to change the first grayscale compensation data to the first data when the third flicker value is greater than the first flicker value, wherein the third flicker value is obtained based on the changed first grayscale compensation data.

18. A test system for testing a plurality of display apparatuses comprising:

a flicker measurement device configured to output a plurality of flicker values corresponding to a plurality of grayscales included in an image, respectively to a display apparatus; and the display apparatus comprising:

a display panel configured to display the image; and a timing controller configured to determine a plurality of minimum compensation data corresponding to the plurality of grayscales, respectively, and a plurality of maximum compensation data corresponding to the plurality of grayscales, respectively, to set the plurality of grayscale compensation data based on the plurality of minimum compensation data and the plurality of maximum compensation data, and to optimize a flicker characteristic with respect to the plurality of grayscales by selectively changing the plurality of grayscale compensation data based on the plurality of flicker values received from the flicker measurement device, wherein the flicker measurement device is further configured to be separtated from the display apparatus when the plurality of grayscale compensation data are set.

* * * * *